United States Patent [19]

Bald

[11] Patent Number: 4,711,116

[45] **Date of Patent: * Dec. 8, 1987**

[54] METHOD OF OPERATING A FOUR-HIGH ROLL STAND WITH BENDABLE AND AXIALLY SHIFTABLE ROLLS

[75] Inventor: Wilfried Bald, Hilchenbach, Fed. Rep. of Germany

[73] Assignee: SMS Schloemann-Siemag AG, Dusseldorf, Fed. Rep. of Germany

[ * ] Notice: The portion of the term of this patent subsequent to Jun. 2, 2004 has been disclaimed.

[21] Appl. No.: 911,959

[22] Filed: Sep. 25, 1986

Related U.S. Application Data

[63] Continuation of Ser. No. 558,165, Dec. 5, 1983, Pat. No. 4,669,296.

[30] Foreign Application Priority Data

Dec. 6, 1982 [DE] Fed. Rep. of Germany ..... 3245090

[51] Int. Cl.[4] ..... B21B 31/18; B21B 31/32

[52] U.S. Cl. ..... 72/366; 72/243; 72/245; 72/247

[58] Field of Search ..... 72/247, 243, 241, 245, 72/365, 366

[56] References Cited

U.S. PATENT DOCUMENTS

| | | | |
|---|---|---|---|
| 2,047,883 | 7/1936 | Phillips | 72/247 |
| 3,857,268 | 12/1974 | Katiwaka | 72/247 |
| 3,943,742 | 3/1976 | Katiwara | 72/247 |
| 4,440,012 | 4/1984 | Feldmann et al. | 72/247 |

FOREIGN PATENT DOCUMENTS

| | | | |
|---|---|---|---|
| 73403 | 6/1980 | Japan | 72/250 |
| 77904 | 6/1980 | Japan | 72/247 |
| 181708 | 11/1982 | Japan | 72/247 |

*Primary Examiner*—Robert L. Spruill
*Assistant Examiner*—Steve Katz
*Attorney, Agent, or Firm*—Karl F. Ross; Herbert Dubno

[57] ABSTRACT

A roll stand has a frame, a pair of small-diameter and substantially parallel working rolls defining a workpiece nip, and respective journal blocks supporting the working rolls in the frame for rotation about substantially parallel axes flanking the nip. These working-roll journal blocks and the respective working rolls can be axially shifted in the frame and the working rolls can be bent positively and negatively, that is respectively convex and concave toward the workpiece. A pair of large-diameter and substantially parallel backup rolls flank and bear toward the nip on the working rolls. Respective journal blocks support the backup rolls in the frame for rotation about substantially parallel axes flanking and generally coplanar with the working-roll axes. A strip is passed repeatedly in a multipass run through the nip generally perpendicular to the plane while the working rolls are pressed against the workpiece to reduce its thickness. The working rolls are axially displaced relative to the workpiece a plurality of times during the run to change the region of contact between the workpiece edges and the working rolls during the run. The working rolls are also bent at least to maintain the workpiece thickness downstream of the nip generally uniform.

3 Claims, 11 Drawing Figures

METHOD OF OPERATING A FOUR-HIGH ROLL STAND WITH BENDABLE AND AXIALLY SHIFTABLE ROLLS

This is a continuation of copending application Ser. No. 558,165 filed on Dec. 5, 1983 now U.S. Pat. No. 4,669,296 issued June 2, 1987

FIELD OF THE INVENTION

The present invention relates to a four-high roll stand. More particularly this invention concerns such a stand whose rolls can be bent and axially shifted.

BACKGROUND OF THE INVENTION

A standard four-high rolling stand of the type used for rolling strip steel has a pair of vertically spaced nip-defining working rolls of relatively small diameter. Respective upper and lower backup rolls of larger diameter bear respectively down and up toward the nip on the respective working rolls. Thus the bendability of the small-diameter working rolls is largely canceled out by the rigidity of the larger-diameter backup rolls so that the large forces required for rolling can be brought to bear on the workpiece.

To achieve even greater uniformity in workpiece thickness, it is now standard to provide six-high roll stands. Such stands have inner and outer backup rolls, the latter being of greater diameter than the former. Even with such a system the workpiece is normally subjected to somewhat more pressure at its longitudinal edges than at its center so that the working rolls wear more at their portions corresponding to the edges of the strip being rolled.

German patent No. 955,131 filed by T. Sendzimir with a claim to a U.S. priority date of Feb. 24, 1943 suggests that this problem can be somewhat alleviated by axially oppositely shifting the two inner backup rolls so that one end of the one working roll and the opposite end of the other working roll are not backed up. A similar such arrangement is described in German patent No. 2,260,256 filed by T. Kajiwara with a claim to the Japanese priority date of Dec. 10, 1971. This allows some deformation of the working rolls in the corresponding regions and thereby ensures more uniformity of workpiece thickness. Such axial shifting of the inner backup rolls allows the stand to be adjusted for the particular workpiece width exactly to produce a rolled product of relatively uniform thickness. In order further to prevent the workpiece from being left slightly too thick at its edges, the working rolls in this system are somewhat crowned, that is are of somewhat greater diameter at their centers than at their ends.

It is also known from U.S. Pat. No. 4,194,382 of T. Kajiwara to provide the axially displaceable inner backup rolls with bending units. In addition in this system, the effective length of the rolls decreases outward from the nip, with the inner backup rolls having shorter effective lengths than the working rolls and the outer backup rolls being shorter than the inner ones.

German patent document Nos. 2,334,492 and 3,115,461 have axially displaceable inner backup rolls and bendable working rolls that are operated by a controller in such a manner as to produce a perfectly flat workpiece.

Another such system is described in copending U.S. Pat. No. 4,543,810 filed Feb. 26, 1982 by Hans Rommen et al and in copending U.S. patent application Ser. No. 558,187 filed Dec. 5, 1983 (now abandoned). These systems employ a six-high roll stand that has a frame, upper and lower working rolls journaled in the frame for rotation about respective parallel upper and lower working-roll axes and defining a workpiece nip, respective upper and lower backup-roll guide elements vertically flanking the working rolls and each at least partially vertically displaceable relative to the frame, and respective upper and lower backup-roll journal blocks axially displaceable but vertically fixed relative to the guide elements and defining parallel upper and lower inner axes flanking the working axes. Respective upper and lower working-roll guide elements level with the working rolls are each at least partially vertically displaceable relative to the frame. Respective upper and lower working-roll journal blocks axially displaceable but vertically fixed relative to the respective guide elements define the working axes. Respective vertically effective actuators exert a force at least generally parallel to the planes between each working-roll journal block and the frame to bend the working rolls and to displace the force axially relative to the working-roll journal blocks. Respective inner backup rolls are journaled in the blocks for rotation about the inner axes and bearing radially toward the nip on the working rolls. The inner backup rolls are axially displaceable in the guide elements. A pair of outer backup rolls are journaled in the frame for rotation about outer axes coplanar with the respective inner axes and bearing radially toward the nip on the inner backup rolls. A control unit including respective vertically effective actuators exerts a force at least generally parallel to the planes between each journal block and the frame to bend the inner backup rolls and for displacing the force axially relative to the journal blocks. A strip workpiece is passed according to this earlier invention in a travel direction through the nip and its thickness is detected downstream of the stand both at its center and edges. The bend of the inner backup rolls is varied when the thickness of the workpiece at its center varies from a predetermined range to return the center thickness to the range and the bend of the working rolls is varied when the thickness of the workpiece at its edges varies from a predetermined range to return the edge thickness to the respective range.

Thus, in addition to varying the bend of the inner backup rolls to correct the central workpiece thickness, the bend of the working rolls is oppositely varied but to a much smaller extent, and in addition to varying the bend of the working rolls to correct the edge workpiece thickness, the bend of the inner backup rolls is oppositely varied but to a much smaller extent.

The workpiece thickness is detected by measuring workpiece tension downstream of the nip. This can be done according to the invention by deflecting the workpiece downstream of the nip over a tension-measuring roller.

OBJECTS OF THE INVENTION

It is therefore an object of the present invention to provide an improved four-high roll stand.

Another object is the provision of such an improved four-high roll stand which overcomes the above-given disadvantages.

Yet another object is to provide an improved method of operating a four-high roll stand to minimize wear of the working rolls and to make the workpiece as uniform in thickness as possible.

SUMMARY OF THE INVENTION

A roll stand according to the invention has a frame, a pair of small-diameter and substantially parallel working rolls defining a workpiece nip, and respective journal blocks supporting the working rolls in the frame for rotation about substantially parallel axes flanking the nip. These working-roll journal blocks and the respective working rolls can be axially shifted in the frame and the working rolls can be bent positively and negatively, that is respectively convex and concave toward the workpiece. A pair of large-diameter and substantially parallel backup rolls flank and bear toward the nip on the working rolls. Respective journal blocks support the backup rolls in the frame for rotation about substantially parallel axes flanking and generally coplanar with the working-roll axes. A strip is passed repeatedly in a multipass run through the nip generally perpendicular to the plane while the working rolls are pressed against the workpiece to reduce its thickness. The working rolls are axially displaced relative to the workpiece a plurality of times during the run to change the region of contact between the workpiece edges and the working rolls during the run. The working rolls are also bent at least to maintain the workpiece thickness downstream of the nip generally uniform.

Thus the instant invention uses the high degree of adjustability of the workpiece nip to allow the working rolls to be displaced and the wear on them to be distributed. In a less flexible system such axial displacement of the working rolls during a run is virtually impossible, as it would surely result in the workpiece having a central thick region and thin edges, termed central bowing, or thick edges and a thin center, termed edge bowing. With the system of this invention however, the axial shifting can be compensated for by appropriate bowing, so a uniform workpiece is produced while the wear on the working rolls, which is principally level with the workpiece edges, can be moved about.

According to this invention the working rolls are axially oppositely displaced, either only until the end of one of the working rolls is generally level with the corresponding workpiece edge and the end of the other working roll is generally level with the other workpiece edge or until the end of one of the working rolls has moved axially past the corresponding workpiece edge and the end of the other working roll has moved axially past the other workpiece edge.

According to further features of this invention edge bowing of the workpiece is corrected by changing the working-roll bend and central bowing of the workpiece is compensated out by canting and horizontally positioning the working rolls, by axially shifting of barrel-shaped rolls, and/or by bending and/or laterally shifting the backup rolls. In addition when compensating out a central bowing the bending of the working rolls is slightly changed counter to that for compensating for edge bowing. This is done by providing a tension-measuring roll downstream of the roll stand and determining workpiece tension at a plurality of zones offset transversely across the workpiece, that is parallel to the roll-stand axes.

The roll stand of this invention has an upper traverse above the upper backup roll and slidably engaging the journal blocks thereof and a lower traverse below the lower backup roll and slidably engaging the journal blocks thereof. The means for axially shifting includes respective actuators connected axially to one of the journal blocks of the respective working rolls. These actuators are normally double-acting hydraulic rams and are constructed as described in the above-cited patent application of Hans Rommen et al.

The journal blocks of the working rolls slide on the journal blocks of the backup rolls. In addition means is provided for bending the backup rolls positively and negatively. This means includes two benders engaging each working-roll journal block.

DESCRIPTION OF THE DRAWING

The above and other features and advantages will become more readily apparent from the following, reference being made to the accompanying drawing in which.

SPECIFIC DESCRIPTION

Figure 1:
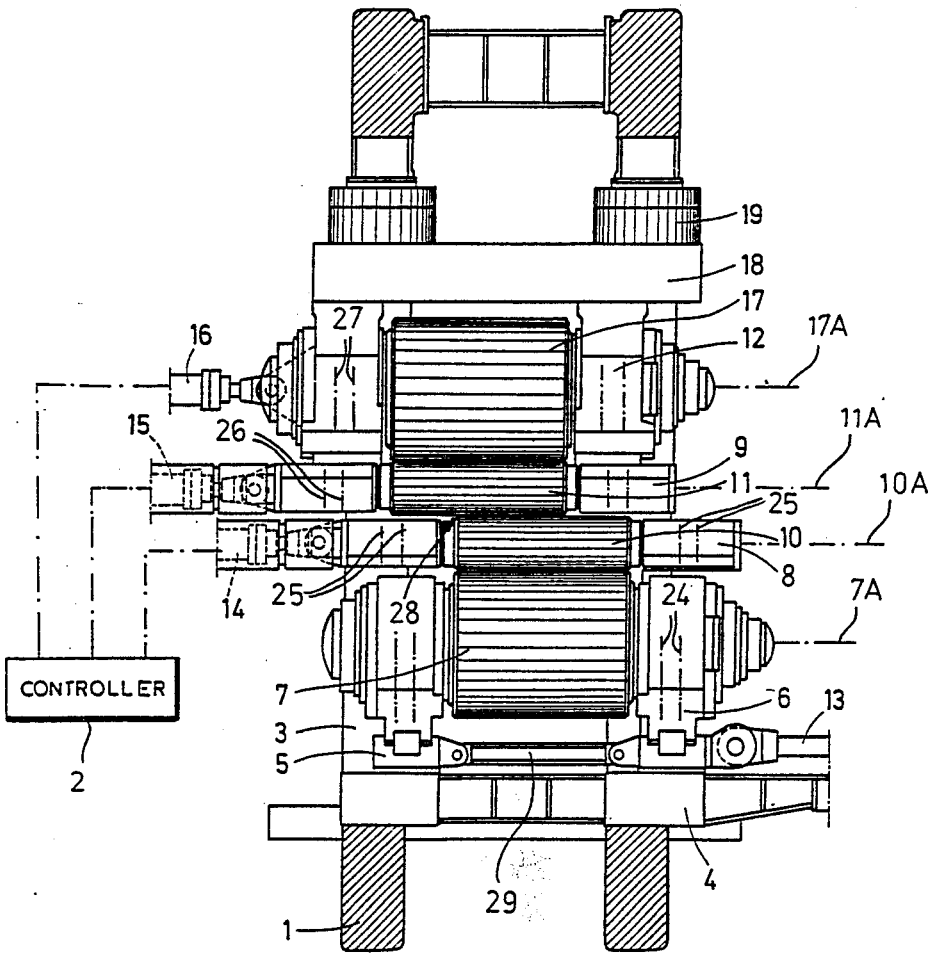
FIG. 1 is a partly schematic end view of a roll stand according to the present invention.

As seen in FIG. 1 a roll stand has a frame 1 formed with a horizontally open window 3 in the bottom of which is provided a traverse 4 on which a pair of slides 5 coupled by a link 28 can move horizontally. These slides 5 support journal blocks 6 of a lower backup roll 7 centered on a horizontal axis 7A. Slidable parallel to the axis 7A on top of these journal blocks 6 are the journal blocks 8 of a lower working roll 10 centered on an axis 10A. Journal blocks 9 of an upper working roll 11 centered on an axis llA are slidable on top of the blocks 8, and further journal blocks 12 of an upper backup roll 17 centered on an axis 17A are slidable atop the blocks 9. An upper traverse 18 is pressed down by actuators 19 against the top of the blocks 12 to compress a workpiece held in a nip 28 defined between the working rolls 10 and 11.

As described in the above-identified copending U.S. patent applications, the blocks 6, 8, 9, and 12 are provided internally with respective pairs of benders 24, 25, 26, and 27 allowing them to be bent positively, that is convex toward the nip 28, and negatively, that is concave toward the nip 28. These benders 24–27 are all operated by a microprocessor-type controller 2.

In addition the blocks 6, 8, 9, and 12 are associated with respective actuators 13, 14, 15, and 16 that can displace them axially relative to one another. The controller 2 is connected to these axially effective actuators 13 -- 16 to operate them jointly or independently of one another.

Figure 2:
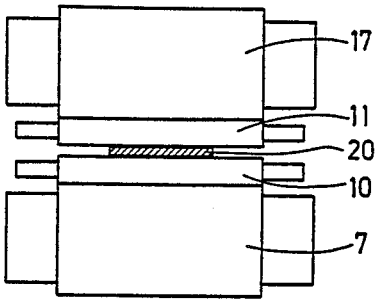
FIG. 2 is an end view illustrating principles of this invention.
Figure 3:
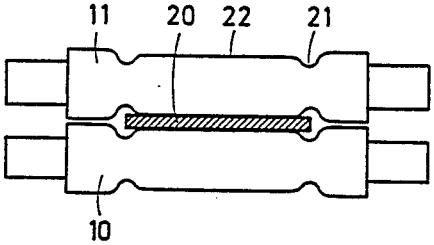
FIG. 3 is an end view of the working rolls of a system operating in accordance with the prior art.

Normally at the start of a rolling run in which a workpiece 20 is passed through the nip 28 a plurality of times the rolls 7, 10, 11, and 17 are vertically aligned as shown in FIG. 2. This vertical alignment is maintained through the entire run in a prior-art system so that, as shown in FIG. 3, the rolls 10 and 11 wear most heavily at the workpiece edges, forming grooves 21 flanking a region 22 of less wear. Once this wear pattern becomes too extreme, it is necessary to remove and turn down the rolls 10 and 11, and eventually to replace them altogether.

Figure 4:
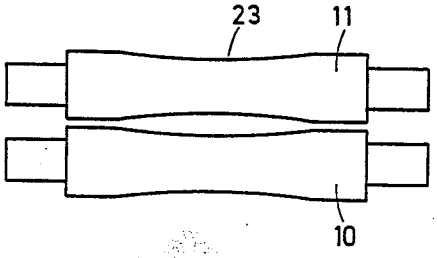
PRIOR ART Fig. 4
FIG. 4 is an end view of the working rolls of a system operating in accordance with the instant invention.

FIG. 4 shows a wear pattern 23 according to the instant invention, that is a slight hyperboloidal shape imparted to the rolls 10 and 11 which are cylindrical or slightly barrel-shaped to start with. This wear pattern 23 is achieved by displacing the rolls 10 and 11 at least axially relative to each other during the run, so that the workpiece edges are not always in contact with the same portions of the rolls 10 and 11. This axial displacement is normally done incrementally, between passes, but can also be executed continuously. It is accompanied by appropriate bending to further reduce roll wear and also to produce a workpiece of uniform thickness.

Figure 5:
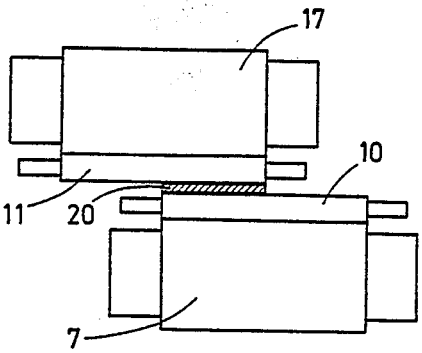
FIGS. 5, 6, 7, and 8 are end views illustrating operating of the roll stand according to this invention.

According to this invention the working rolls 10 and 11 and shifted axially oppositely. As shown in FIG. 5 they can be moved jointly with the respective backup rolls 7 and 17 until the ends of the rolls 7 and 10 are axially level or aligned with the one workpiece edge and the opposite ends of the rolls 11 and 17 are level with the opposite workpiece edge. In this position the line loads are the same as in a six-high stand, however the pressure is better distrubuted than in a six-high unit.

Figure 6:
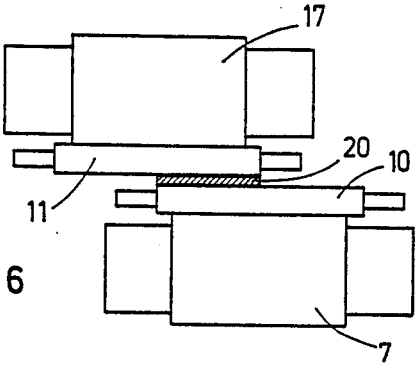

As shown in FIG. 6 it is also possible to continue moving the backup rolls 7 and 17 once the FIG. 5 position has been reached until their ends have passed the respective workpiece edges. This leaves a short end portion of each working roll 10 and 11 unsupported, but any deformation can be relatively easily compensated for by appropriately bending these rolls 10 and 11.

Figure 7:
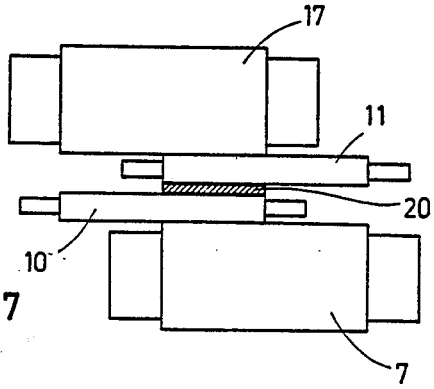
Figure 8:
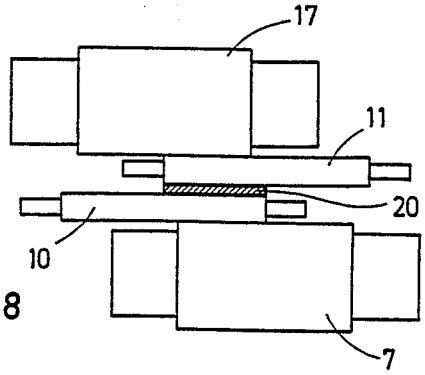

FIGS. 7 and 8 show a system wherein the working rolls 10 and 11 are shifted oppositely, and the respective backup rolls 7 ane 17 are shifted in turn oppositely to them, so that the rolls 10 and 17 move in one axial direction and the rolls 7 and 11 in the opposite one. In FIG. 7 the ends of the backup rolls are level with the respective edges of te workpiece 20, and in FIG. 8 they have moved therebeyond. In such an overcompensated position negative bending of the working rolls 10 and 11, which are cylindrical, is employed.

Figure 9A:
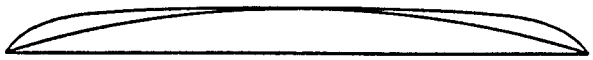
FIGS. 9*a*, 9*b*, and 9*c* are diagrams illustrating principles of this invention.
Figure 9B:
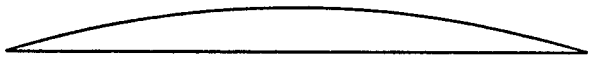
Figure 9C:
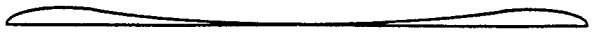

The actual bending forces in the working and inner backup rolls are determined based on the recognition that the bending of the working and backup rolls is not only different because of their stiffness and loading, but also because the backup roll bending is mathematically a quadratic/parabolic deformation whereas the bending of the working roll is of a higher order. FIG. **9*b* shows by way of example the overall positive curvature of a rolled strip wherein the surface portion lying above a plane is shown. Such a curvature is the result of a central bowing which is not only symmetrical to the middle plane of the workpiece but also has its peak at this point and which can be described by a quadratic/parabolic equation. FIG. 9*c* shows that part of the overall curvature of FIG. 9*a* which is characterized as edge bowing and has two peaks which lie adjacent the workpiece edges. FIG. 9*a*** shows the sum of these two curvatures.

Thus the bending of the working rolls produces this edge bowing which has more than one peak while other means affecting the nip shape control the central bowing. According to this invention when correcting the nip shape and correcting the edge-bowing component of the overall bowing, bending forces are used whereas for compensating for the overall central bowing various other means can be employed. Thus for example the working rolls can be shifted horizontally at an angle or canted, even assymetrically to the central plane of the stand which is perpendicular to the roll axes. It is also possible not to use the axial position of the working rolls to distribute the wear or to correct the shape of the working-roll nip, but instead to use barrel-shaped rolls that control the central bowing. In addition axial shifting of the backup rolls, when same are not too large in diameter so they can be bent, makes corrections possible.

These corrections are accomplished as described in the above-cited applications by measuring strip tension downstream of the roll stand with a device such as described in German patent No. 1,573,407 filed by O. Sivilotti et al with a claim to a Swedish priority date of Oct. 5, 1965. As mentioned in the above-cited application, central bowing is compensated for mainly by bending the working rolls and edge bowing mainly by bending the backup rolls.

I claim:

1. A method of operating a four-high roll stand comprising:

a frame;

a pair of small-diameter and substantially parallel work rolls defining a workpiece nip;

respective journal blocks supporting the work rolls in the frame for rotation about substantially parallel axes flanking the nip;

means for axially shifting the work-roll journal blocks and the respective work rolls in the frame;

respective means for bending the work rolls positively and negatively;

a pair of large-diameter and substantially parallel backup rolls flanking and bearing toward the nip on the work rolls;

respective journal blocks supporting the backup rolls in the frame for rotation about substantially parallel axes flanking and generally coplanar with the work-roll axes; and means for axially shifting the backup-roll journal blocks and the respective backup rolls in the frame;

the method comprising the steps of:

axially positioning the backup rolls relative to each other according to the width of a strip workpiece to be rolled and maintaining the same relative axial positions of the backup rolls for all workpieces of equal width;

axially positioning the work rolls relative to each other in a position that differs from their positions during previous strip runs for strips of equal width;

thereafter passing a strip workpiece through the nip perpendicular to the plane of the roll axes while pressing the work rolls against the strip workpiece to reduce its thickness and while maintaining the relative axial position of the work rolls unchanged;

after having completed the run of the strip workpiece, axially displacing the work rolls relative to the next strip workpiece and thereby changing the region of contact between the workpiece edges and the work rolls during a following run with the next strip workpiece; and bending the work rolls by bending the backup rolls independently of the axial position of the work rolls to such an extent as to generate a predetermined rolled strip profile in the workpieces.

2. The method defined in claim 1 wherein said work rolls are axially oppositely displaced.

3. A method of operating a four-high roll stand comprising:

a frame;

a pair of small-diameter and substantially parallel work rolls defining a workpiece nip;

respective journal blocks supporting the work rolls in the frame for rotation about substantially parallel axes flanking the nip;

means for axially shifting the work-roll journal blocks and the respective work rolls in the frame;

respective means for bending the work rolls positively and negatively;

a pair of large-diameter and substantially parallel backup rolls flanking and bearing toward the nip on the work rolls;

respective journal blocks supporting the backup rolls in the frame for rotation about substantially parallel axes flanking and generally coplanar with the work-roll axes; and means for axially shifting the backup-roll journal blocks and the respective backup rolls in the frame; the method comprising the steps of:

axially positioning the backup rolls relative to each other according to the width of a predetermined strip workpiece to be rolled;

axially positioning the work rolls relative to each other in a position that differs from their positions during previous strip runs for strips of equal width;

thereafter passing the predetermined strip workpiece through the nip perpendicular to the plane of the roll axes while pressing the work rolls against the strip workpiece to reduce its thickness and while maintaining the relative axial position of the work rolls unchanged;

after having completed the run of the strip workpiece, axially displacing the work rolls relative to another strip workpiece of the same with and thereby changing the region of contact between the workpiece edges and the work rolls during a following run with a next strip workpiece;

thereafter passing the next strip workpiece repeatedly in a multipass run through the nip perpendicular to the plane of the roll axes while pressing the work rolls against the strip workpiece to reduce its thickness and while maintaining the relative axial position of the work rolls unchanged; and bending the work rolls by bending the backup rolls independently of the axial position of the work rolls to such an extent as to generate a predetermined rolled strip profile in the workpiece.

* * * * *